United States Patent [19]

Johnston et al.

[11] Patent Number: 4,949,068

[45] Date of Patent: Aug. 14, 1990

[54] MOTORCYCLE SOUND SIMULATOR FOR A CHILD'S TOY

[75] Inventors: John Johnston, 3230 Colima Rd., Atascadero, Calif. 93422; Dee Jordan, Bakersfield, Calif.

[73] Assignee: John Johnston, Atascadero, Calif.

[21] Appl. No.: 277,016

[22] Filed: Nov. 28, 1988

[51] Int. Cl.[5] ..... G08B 3/00

[52] U.S. Cl. ..... 340/384 E; 273/86 B

[58] Field of Search ..... 340/384 E, 384 R; 280/1.14, 828; 273/86 B; 446/7, 404, 409, 418; 381/98

[56] References Cited

U.S. PATENT DOCUMENTS

| | | | |
|---|---|---|---|
| 3,718,987 | 3/1973 | Carver | 340/384 E X |
| 3,735,529 | 5/1973 | Roslen | 446/418 |
| 3,845,572 | 11/1974 | McCanney | 340/384 E X |
| 3,872,470 | 3/1975 | Hoerz et al. | 340/384 E |
| 4,204,200 | 5/1980 | Beyl, Jr. | 340/384 E |
| 4,247,107 | 1/1981 | Smith, III et al. | 273/86 B |
| 4,314,236 | 2/1982 | Mayer et al. | 340/384 E |
| 4,437,088 | 3/1984 | Ferguson | 340/384 E |
| 4,531,751 | 7/1985 | Todokoro | 280/1.14 X |
| 4,701,750 | 10/1987 | Wilkinson et al. | 340/384 E |

*Primary Examiner*—Joseph A. Orsino
*Assistant Examiner*—Brian R. Tumm
*Attorney, Agent, or Firm*—Jerry N. Lulejian

[57] ABSTRACT

A device for simulating the sound of a motorcycle as a child's toy in which the simulated sound is composed of at least two rectangular waves partially out of phase with each other, mixed and amplified. The frequency (and preferably the volume) of the mixed rectangular waves varies with the position of a rotatable simulated throttle.

8 Claims, 2 Drawing Sheets

MOTORCYCLE SOUND SIMULATOR FOR A CHILD'S TOY

BACKGROUND OF THE INVENTION

The present invention is concerned with the simulation of the sound of a motorcycle (especially a motocross motorcycle) and the use of this simulated sound as a child's toy.

There have been several attempts in the past to create such a simulated sound by mechanical means. Typically, these attempts involved an electric motor whose shaft is connected to a striker. The striker hits a diaphragm each time the electric motor turns one revolution. The intensity of the sound is controlled by varying the distance between the striker and the diaphragm so the striker hits the diaphragm with more or less intensity.

These mechanical attempts to simulate motorcycle sound have been sadly lacking in fidelity to a true motorcycle sound because the frequency of the sound could not be controlled. As we all know, the "popping" sound of a revving motorcycle engine varies its frequency with the varying position of the throttle during the revving maneuver. However, it is this revving sound which is most popular with children.

Examples of these attempts are found in U.S. Pat. Nos. 1,571,489; 3,439,926; 4,151,677; 4,531,751; and 3,875,696.

The present invention is responsible for the first motorcycle sound simulator which not only involves no moving parts but better simulates motorcycle engine sounds by varying the frequency of the "popping" sound with the position of the throttle of the sound simulator. Thus, the child using the present invention can better simulate the most popular sound of a motorcycle by "revving his engine" with his turning of the simulated throttle of the present invention.

SUMMARY OF THE INVENTION

The present invention is a device for simulating the sound of a motorcycle and typically comprises (1) at least two oscillation means, each such means for creating an electrical oscillation, each oscillation being at least partially out of phase with the other oscillations; (2) a means for proportionately varying the frequencies of the electrical oscillations; (3) a means for mixing the electrical oscillations together; and (4) a means for converting the mixed electrical oscillations into audible sound waves.

The at least two oscillation means preferably comprise two such means. Each of the electrical oscillations is preferably a positive going rectangular wave having a pulse width. Preferably, one electrical oscillation has a wider pulse width than the other electrical oscillation. The frequency range of one of the oscillation means is from approximately seventeen (17) Hertz to approximately one hundred thirty one (131) Hertz. The frequency of the other oscillation means is from approximately four (4) Hertz to approximately twenty four (24) Hertz. The pulse width of the oscillation with the wider pulse width is approximately twelve (12) microseconds at its lowest frequency. The pulse width of the oscillation with the smaller pulse width is approximately six and one-half (6.5) microseconds at its lowest frequency.

Each oscillation means typically comprises an operational amplifier circuit caused to oscillate by the feeding back its output to its input. The frequency of the oscillations from each operational amplifier is controlled by a variable resistance means. The variable resistance means is a potentiometer.

The means for converting the electrical oscillations into audible sound typically comprises an audio amplifier circuit and speaker interconnected to the means for mixing the electrical oscillations. The audio amplifier circuit and speaker further comprise a means for varying the intensity of the audible sound of the converted electrical oscillations. The means for varying the intensity of the audible sound of the converted electrical oscillations is a potentiometer.

DETAILED DESCRIPTION OF THE INVENTION

The present invention is concerned with the simulation of the sound of a motorcycle (especially a motocross motorcycle) and the use of this simulated sound as a child's toy.

There have been several attempts in the past to create such a simulated sound by mechanical means. Typically, these attempts involved an electric motor whose shaft is connected to a striker. The striker hits a diaphragm each time the electrical motor turns one revolution. The intensity of the sound is controlled by varying the distance between the striker and the diaphragm so the striker hits the diaphragm with more or less intensity.

These mechanical attempts to simulate motorcycle sound have been sadly lacking in fidelity to a true motorcycle sound because the frequency of the sound could not be controlled. As we all know, the "popping" sound of a revving motorcycle engine varies its frequency with the varying position of the throttle during the revving maneuver. However, it is this revving sound which is most characteristic of motorcycle sound and which is the most popular with children.

The present invention is responsible for the first motorcycle sound simulator which not only involves no moving parts but better simulates motorcycle engine sounds by varying the frequency of the "popping" sound with the position of the throttle of the sound simulator. Thus, the child using the present invention can better simulate the most popular sound of a motorcycle by "revving his engine" with his turning of the simulated throttle of the present invention.

Figure 1:
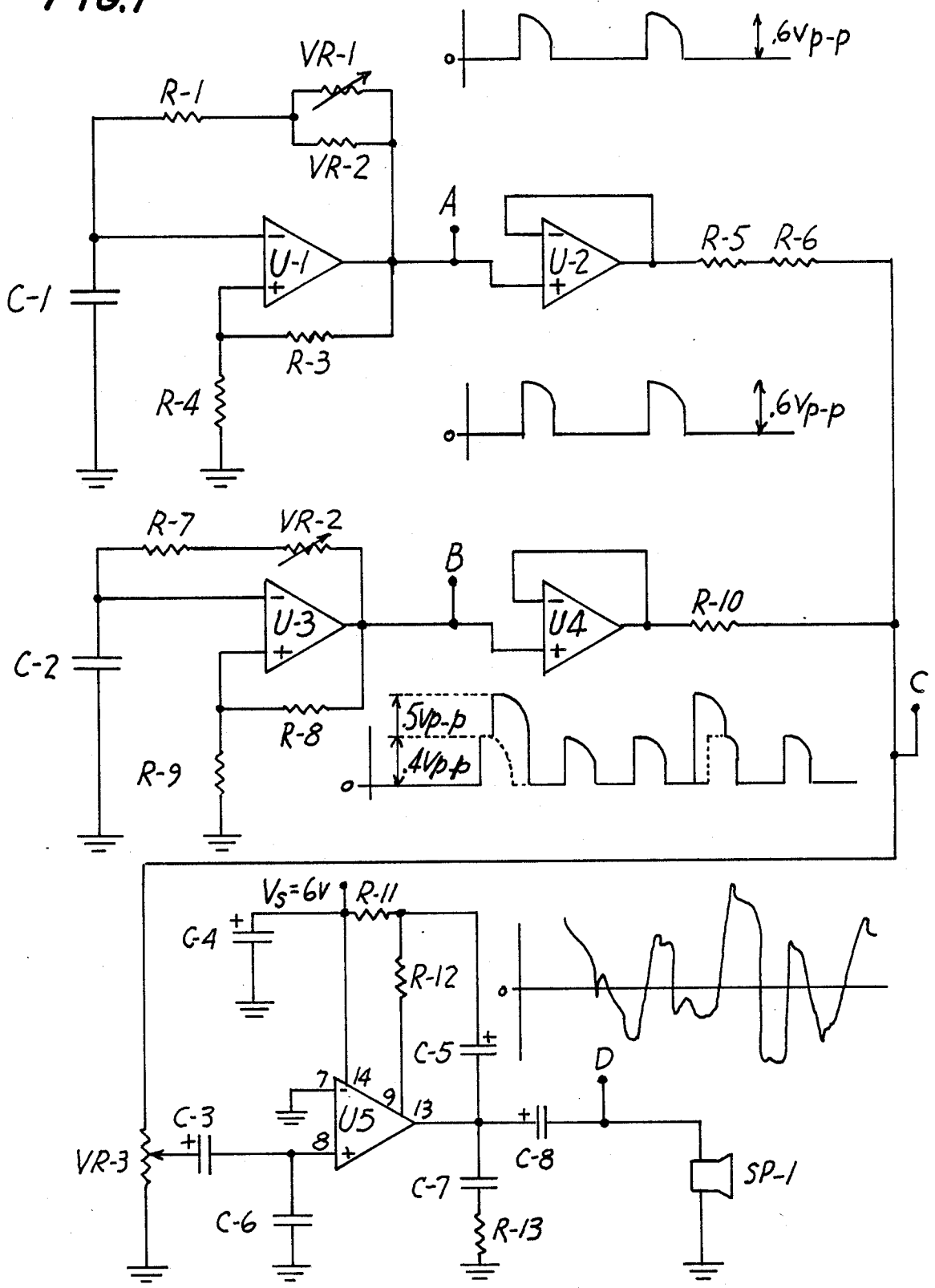
FIG. 1 is an electronic schematic drawing of the preferred embodiment of the motorcycle sound simulator of the present invention.

Referring specifically to FIG. 1, the preferred embodiment of the present invention typically comprises low power operational amplifiers U-1 and U-3 each configured with a feedback network comprised of capacitor C-1, resistors R-1 through R-4 and capacitor C-2 and resistors R-7 through R-9, respectively. The frequency of the oscillations from U-1 and U-3 are controlled by variable resistors VR-1 and VR-2, respectively. VR-1 and VR-2 are preferably ganged so that their resistance is always the same no matter what resistance value they may have.

Operational amplifiers U-2 and U-4 are configured to operate as buffers to prevent U-1 and U-3 from affecting each other when the oscillations from each are mixed together. U-1 through U-4 are preferably a single LM 324 quad low power operational amplifier integrated circuit.

The oscillations from U-1 and U-3 are mixed together and amplified by high power audio amplifier U-5. U-5 is preferably an LM 390. The amplified mixed oscillations are made audible through speaker SP-1 which is preferably an eight (8) ohm speaker rated at eight (8) watts or higher to take the maximum output from U-5.

The entire circuitry of the present invention can be powered by a six (6) volt lantern battery (unshown) or any other battery which will allow a reasonable operational life under normal use.

The oscillations from U-1 preferably consist of a string of positive going rectangular waves (shown at point A on FIG. 1). The typical pulse width at its lowest frequency of seventeen (17) Hertz is six and onehalf (6.5) microseconds and varies to as low as seven tenths (0.7) of a microsecond at its highest frequency of one hundred thirty one (131) Hertz. This pulse train typically has a pulse height of six tenths (0.6) volt peak to peak.

The oscillations from U-3 preferably consist of a string of positive going rectangular waves (shown at point B of FIG. 1). The pulse width is preferably twelve (12) microseconds at its lowest frequency of four (4) Hertz and varies to as low as two and six tenths (2.6) microseconds at its highest frequency of twenty four (24) Hertz.

The oscillations from U-1 and U-3 are preferably at least partially out of phase from each other. The mixture of the preferred oscillations is shown at point C of FIG. 1. As can be seen, there is preferably some coincidence between the two preferred wave trains from U-1 and U-3.

This preferred mix is amplified by U-5 and its associated components. The mixed wave trains are shaped primarily by the charging and discharging of capacitor C-8 on the output of U-5. The typical waveform resulting after its amplification by U-5 and its associated components is seen at point D of FIG. 1. The depicted waveform in all of its differing phases controlled by the simulated throttle 20 (FIG. 2) more perfectly simulates real motorcycle sound throughout the range of the real throttle of the motorcycle.

The volume of sound exiting speaker SP-1 can be controlled through variable resistor VR-3. VR-3 may be installed in a location within the box 10 containing the present invention (FIG. 2) which is accessible only by a screw driver or other implement in order to allow the child's parent to set the level of motorcycle sound. This placement would be of special importance if the vehicle ridden by the child in conjunction with the present invention is ridden indoors. However, VR-3 can also be ganged with VR-1 and VR-2 in order to make a more pronounced revving sound when the throttle 20 (FIG. 2) of the present invention is quickly turned through its range of operation.

Figure 2:
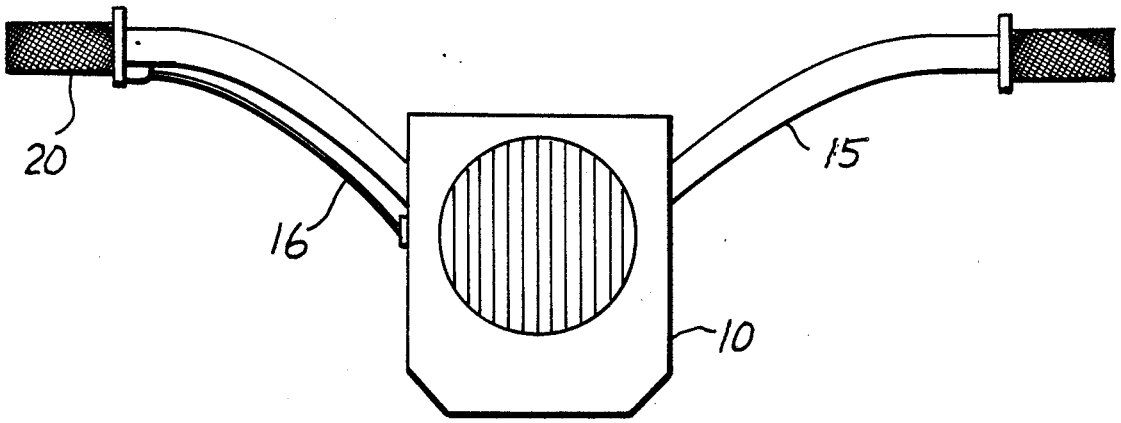
FIG. 2 is a front elevational view of preferred embodiment of the motorcycle sound simulator of the present invention with its simulated throttle fastened to handlebars of a child's bicycle.

Referring specifically to FIG. 2, the present invention is preferably housed in a box 10 which may be mounted with conventional hardware to a child's bicycle handlebars 15. A multi-conductor wire 16 runs from the box 10 to the throttle 20. The throttle 20 is preferably a separate handle installable on the handlebars 15 which when rotated changes the resistance of VR-1 and VR-2 (and possibly VR-3) in a ganged fashion as described above.

When the throttle 20 is in its lowest position the sound will be a mild motorcycle idle sound. As the throttle 20 is rotated to higher positions the sound becomes higher in frequency as if the child had increased the throttle on a real motocross motorcycle. If VR-3 is also ganged with VR-1 and VR-2 within throttle 20, then the volume would increase as the frequency of the sound increased creating a more realistic motocross motorcycle operation. VR-3 could be either audio taper or linear taper as preferred. However, the audio taper would give the most realistic effect.

In the preferred embodiment of the present invention the components other than the integrated circuits previously described have the following values:

R-1 six (6) Kiloohms
R-2 one hundred twenty (120) kiloohms
R-3 two hundred twenty (220) kiloohms
R-4 four hundred seventy (470) kiloohms
R-5 four and seven tenths (4.7) kiloohms
R-6 fifteen (15) kiloohms
R-7 fifty six (56) kiloohms
R-8 one hundred twenty (120) kiloohms
R-9 four hundred seventy (470) kiloohms
R-10 fifteen (15) kiloohms
R-11 one hundred eighty (180) ohms
R-12 one hundred eighty (180) ohms
R-13 two and seven tenths (2.7) ohms
VR-1 and VR-2 one hundred (100) kiloohm ganged potentiometers (linear or audio taper as preferred).
C-1 one tenth (0.1) microfarad
C-2 forty seven one thousandths (0.047) microfarad
C-3 four and seven tenths (4.7) microfarad electrolytic.
C-4 one tenth (0.1) microfarad electrolytic
C-5 twenty two (22) micrfarad electrolytic
C-6 one hundred picofarad
C-7 forty seven thousandths (0.047) microfarad
C-8 two hundred twenty (220) microfarad electrolytic Each resistor is rated at one half (0.5) watts and each capacitor has a working voltage of at least sixteen (16) volts preferably.

The above description of the preferred embodiment is for illustrative purposes only and shall not be considered to limit the scope of the present invention. Instead, the scope of the present invention shall be defined by the following claims and their equivalents.

I claim:

1. A device for simulating the sound of a motorcycle, comprising:

at least two oscillation means, each such means for creating an electrical oscillation, each oscillation being at least partially out of phase with the other oscillation;

a means for proportionately varying the frequencies of the electrical oscillations;

a means for mixing the electrical oscillations together;

a means for converting the mixed electrical oscillations into audible sound waves;

the at least two oscillation means comprise only two such means;

each of the electrical oscillations is a positive going rectangular wave having pulse width;

one said electrical oscillation has a wider pulse width than the other electrical oscillation; and the frequency range of one of the oscillation means is from approximately seventeen (17) Hertz to approximately one hundred thirty one (131) Hertz.

2. The device in accordance with claim 1 in which each said oscillation means comprises an operational amplifier circuit to cause said oscillation by the feeding back of its output to its input and in which the frequency of the oscillations from each operational amplifier is controlled by said means for proportionately varying the frequencies of the electrical oscillations, which means comprises a variable resistance means.

3. The device in accordance with claim 12 in which the variable resistance means is a potentiometer.

4. The device in accordance with claim 1 in which pulse width of the oscillation with the smaller pulse width is approximately six and one-half (6.5) microseconds at its lowest frequency and seven tenths (0.7) microseconds at its highest frequency.

5. The device in accordance with claim 4 in which the lowest frequency of the oscillation with the smaller pulse width is approximately seventeen (17) Hertz and the highest frequency of the oscillation with the smaller pulse width is approximately one hundred thirty one (131) Hertz.

6. The device in accordance with claim 1 in which the frequency range of the other oscillation means is from approximately four () Hertz to approximately twenty four (24) Hertz.

7. The device in accordance with claim 1 in which the pulse width of the oscillation with the wider pulse width is approximately twelve (12) microseconds at its lowest frequency and approximately two and six tenths (2.6) microseconds at its highest frequency.

8. The device in accordance with claim 7 in which the lowest frequency of the oscillation with the wider pulse width is approximately four (4) Hertz and the highest frequency of the oscillation with the wider pulse width is approximately twenty four (24) Hertz.

* * * * *